United States Patent [19]

Fabricant et al.

[11] 4,136,480

[45] Jan. 30, 1979

[54] PUZZLE PULL TOY

[75] Inventors: Norman Fabricant, Rego Park, N.Y.; Matthew A. Moustakas, Mercerville, N.J.

[73] Assignee: CBS Inc., New York, N.Y.

[21] Appl. No.: 776,159

[22] Filed: Mar. 10, 1977

[51] Int. Cl.[2] ..... A63H 33/06

[52] U.S. Cl. ..... 46/17; 46/223; 273/157 R

[58] Field of Search ..... 46/16, 17, 23, 30, 202; 273/157 R; 46/223

[56] References Cited

U.S. PATENT DOCUMENTS

| | | | |
|---|---|---|---|
| 1,321,109 | 11/1919 | Lasares | 46/17 |
| 2,475,306 | 7/1949 | Beder | 273/157 R X |
| 2,491,296 | 12/1949 | Beder | 273/157 R |
| 2,510,884 | 6/1950 | Greene | 46/2 |
| 2,617,654 | 11/1952 | Nolan et al. | 46/17 |
| 3,224,137 | 12/1965 | Wright et al. | 46/17 X |
| 3,439,445 | 4/1969 | Tarrson | 46/17 |
| 3,528,193 | 9/1970 | Yamakawa | 46/17 |
| 3,608,233 | 9/1971 | Aoki | 46/17 |
| 4,043,056 | 8/1977 | Savage | 273/157 R X |
| 4,061,339 | 12/1977 | Coster | 46/223 X |

OTHER PUBLICATIONS

Embree Manuf'g Co., Box 678, Elizabeth, N.J. 07207 #CMA-2, Changeable Mary Ann, Toy Fair, 3/1970.

*Primary Examiner*—Russell R. Kinsey

*Assistant Examiner*—Mickey Yu

*Attorney, Agent, or Firm*—Spencer E. Olson

[57] ABSTRACT

An instructive amusement device for young children that embodies the concept of a puzzle for enhancing the child's intellectual and motor skills by requiring correct assembly of puzzle pieces, and also to stimulate learning about wheeled vehicles that the child can be expected to see in the world around him. The device includes a wheeled wagon on which is supported a vertically oriented rectangular frame having a pocket for receiving and retaining in edgewise juxtaposition a plurality of puzzle pieces each in the form of a flat elongated strip having a length substantially equal to the length dimension of the frame. The puzzle pieces each have fragmentary pictorial representations on each of its two flat surfaces which, when the puzzle pieces are juxtaposed edgewise in the frame in correct order and with correct longitudinal orientation, create on the two opposite surfaces of the assembled puzzle pieces complete pictorial representations of two different views of the body portion of a wheeled vehicle. When properly assembled the device serves as a pull toy representative of a particular kind of vehicle of which the wheeled wagon is the "chassis" on which the child has assembled the "body". For greater complexity, the device preferably includes several sets of puzzle pieces, each set representing one of several different familiar vehicles, such as a garbage truck, an ice cream truck, a passenger car, and a dump truck.

5 Claims, 6 Drawing Figures

PUZZLE PULL TOY

BACKGROUND OF THE INVENTION

This invention relates to amusement devices for children, and more particularly, to a pull toy for children of pre-school age characterized by having a number of visually associable parts for the child to assemble and disassemble on the pull toy, the parts being so related to each other that when properly assembled will depict a vehicle.

Many kinds and types of pull toys have heretofore been developed and marketed, most of which are simply wheeled vehicles on which are supported a representation of some real life object, such as an animal, a truck, or the like, and sometimes include animation or noise-making devices that are actuated as the toy is moved. In general, such toys are permanently assembled, giving the child no opportunity to learn anything about the construction of the toy, which often leads to a short interest span and a tendency for the child to abandon the toy. There are, of course, exceptions to this general categorization of pull toys, an example of which is the moving toy described in U.S. Pat. No. 3,528,193 which can be readily assembled and disassembled by children so that their destructive and creative instincts can be satisfied.

Similarly, there are many known forms of puzzles, of different degrees of complexity, of the type having a number of parts that a child can assemble to produce a desired pictorial representation and/or to display numbers, figures and letters so that the child will learn to observe and spell. Examples of this class of puzzle are described in U.S. Pat. Nos. 2,491,296 and 2,510,884.

The primary object of the present invention is to provide education and amusement for children by providing a pull toy which embodies the concept of a puzzle which when correctly assembled depicts the characteristics of familiar four-wheeled vehicles.

BRIEF DESCRIPTION OF THE INVENTION

Briefly, the amusement device according to the invention includes a wheeled wagon on which is supported an upright rectangular frame having a pocket therein for receiving and retaining in edgewise juxtaposition a number of puzzle pieces in the form of flat elongated strips. The puzzle pieces each have fragmentary pictorial representations on each of its two flat surfaces which, when the puzzle pieces of a set are juxtaposed edgewise in the frame in correct order and with correct longitudinal orientation, creates on the two opposite surfaces of the assembled puzzle pieces complete pictorial representations of two different views of the body portion of a given wheeled vehicle. A preferred embodiment of the amusement device includes four sets of puzzle pieces, each set when properly assembled depicting one of four different vehicles, thereby adding to the complexity of the puzzle and adding to the educational value of the toy. The child must select from sixteen strips, all of which have different, but in some cases similar, pictorial representations on its opposite sides and assemble in proper bottom to top order and with correct longitudinal orientation, four of the strips which together correctly depict a particular vehicle. When properly assembled, the pull wagon "chassis" and the "body" depicted by the assembled puzzle pieces provides a pull toy of lasting interest to the child because he has, in essence, built it. When the child tires of a particular vehicle, he is challenged to create another by proper assembly of four other puzzle pieces.

BRIEF DESCRIPTION OF THE DRAWINGS

Other objects, features and advantages of the invention will become apparent, and its construction better understood, from the following detailed description, taken in conjunction with the accompanying drawings, in which.

DESCRIPTION OF THE PREFERRED EMBODIMENT

Figure 1:
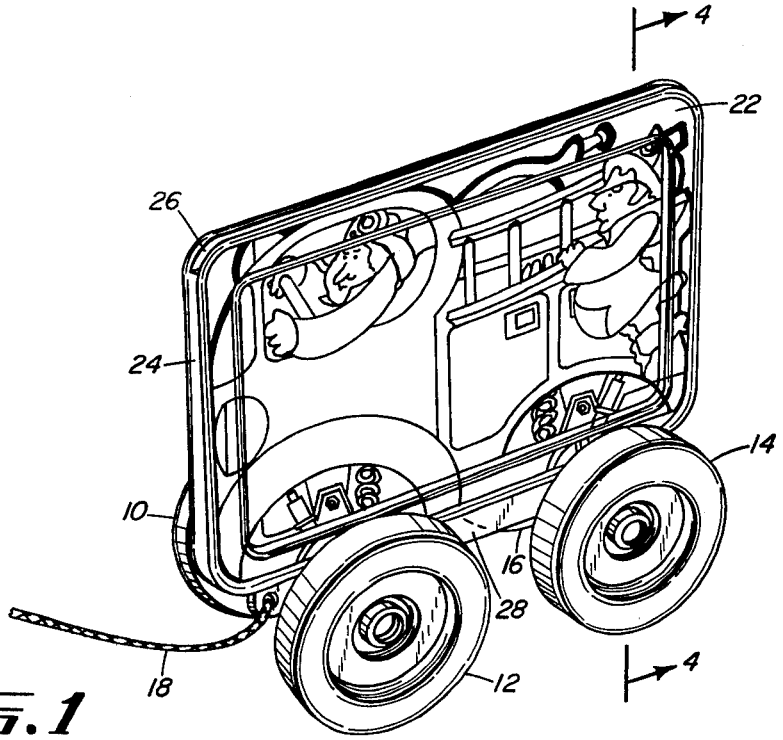
FIG. 1 is a perspective view of the amusement device constructed in accordance with the invention.
Figure 2:
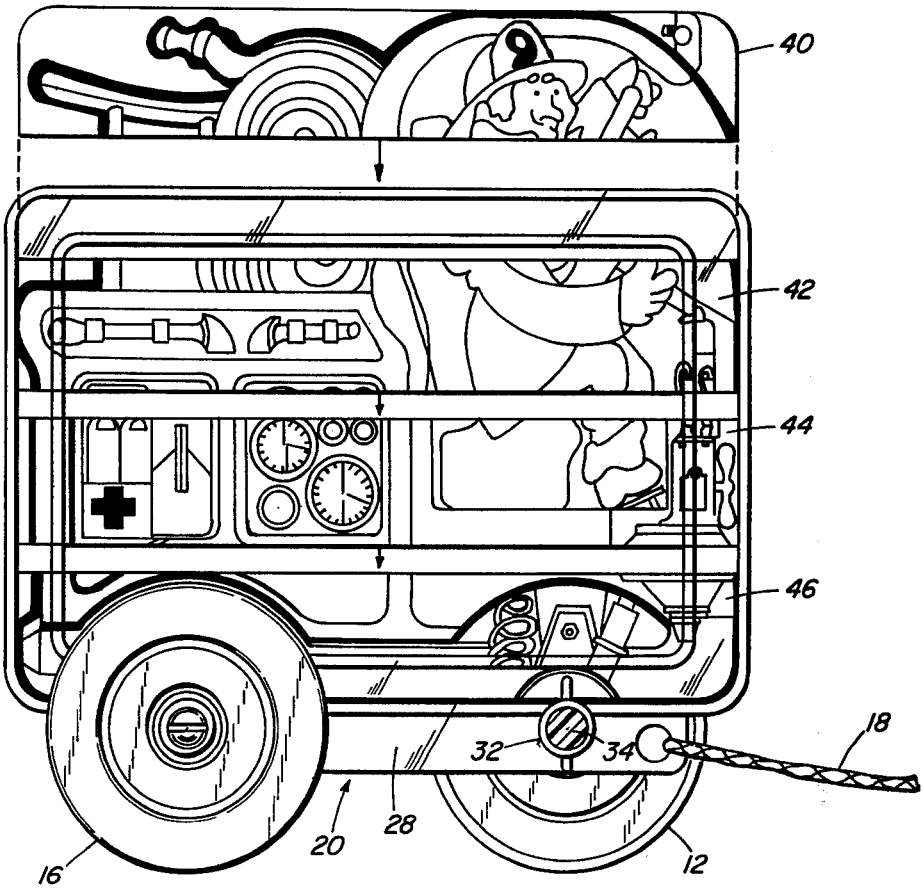
FIG. 2 is an elevation view, partially cut away, of the side of the toy opposite that shown in FIG. 1, and illustrating the insertion of puzzle pieces.
Figure 3:
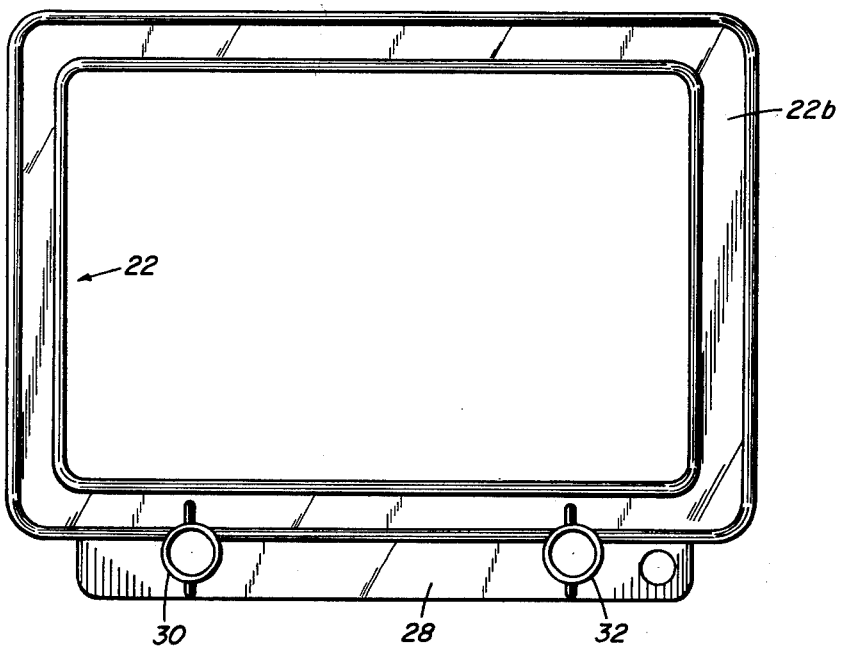
FIG. 3 is an elevation view of the chassis and frame of the wheeled wagon.
Figure 4:
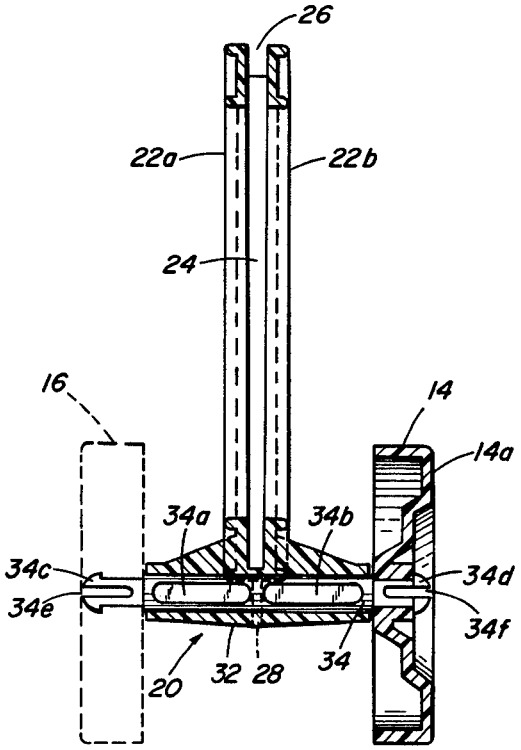
FIG. 4 is a cross-sectional view taken along line 4—4 in FIG. 1.

The combination puzzle and pull toy according to the invention includes a wheeled wagon, illustrated in FIGS. 1–4, having four wheels 10, 12, 14 and 16, which is adapted to be pulled along a flat surface by a pull string 18 secured to one end of the "chassis" 20 of the wagon. As best seen in FIGS. 3 and 4, the "chassis" consists of a vertically oriented rectangular frame 22, which in a typical embodiment, may have a frame width of ½ inch and outside dimensions of 6⅜ inches long and 4½ inches high. The frame consists essentially of two spaced apart rectangular "rings" **22*a* and 22*b*, perferably formed of transparent plastic material having a nominal wall thickness of 0.078 inch, stiffened by ribs at their inner and outer peripheries. The "rings" are maintained in spaced apart relationship by spacers, one of which is visible at 24 in FIG. 4, integrally joined to the rings along the outer peripheries of the two vertical sides and the bottom side, there being no spacer between the "rings" forming the upper side of the frame, however, so as to provide an opening 26** along the upper edge for the insertion of puzzle pieces, to be described. In effect, then, the frame provides a vertically oriented pocket, open at the top, for receiving flat sheet material of a thickness slightly less than the spacing between the "rings", which in the preferred embodiment is 0.145 inch.

Further stiffening and structural support for the frame is provided by a web or septum 28 integrally joined to the lower edge of the frame 22 and extending throughout the major portion of its length. A pair of outer axles 30 and 32 are integrally molded with the frame and septum 28, and, as shown in FIG. 4, extend equidistantly from opposite sides of the frame, typically by one inch, to give the outer axles an overall length of two inches. In the preferred embodiment, the frame 22, the septum 28, and the outer axles 30 and 32, are molded as one pice from a suitable transparent plastic material, such as that known as "Stayflo" marketed by Air Products Company.

The outer axles 30 and 32 have inside bores dimensioned to snugly receive an inner axle, one of which is visible at 34 in FIG. 4. The inner axle may be of circular cross-section throughout its length, or, in the interest of reducing weight and cost of material, may be formed with cutouts, two of which are visible at **34*a* and 34*b* in FIG. 4. The axles are of a length to extend beyond the outer extremities of the outer axles sufficiently to receive wheels thereon, and are provided at their ends with hemispherical protuberances 34c and 34d and slots 34e and 34f**. The plastic material is sufficiently pliant that the slots allow the ends of the axle to be compressed to allow a wheel to be forced over the protuberance and to spring back and retain the wheel on the axle. In the preferred embodiment, the axles are molded from the same transparent material as is used for fabrication of the frame, it having sufficient flexibility and memory to permit use of the described technique for securing the wheels to the axles.

The four wheels are all of the same construction, are preferably formed of plastic material, and in the preferred embodiment, have the cross-section illustrated in FIG. 4. As shown, the wheel has a hub portion dimensioned to be forced over the protuberance at the end of the inner axle and to engage a reduced-diameter portion of the inner axle inwardly from the protuberance, the hub portion being disposed inwardly from the "tire" portion 14a of the wheel to simulate the wheels and tires of real-life cars and trucks. For interest and contrast, the wheels are preferably formed of a colored plastic material.

From the description thus far, it will be apparent that the wagon is an assembly of only seven molded plastic parts: the frame and outer axles, two inner axles, and four wheels. It is relatively inexpensive to manufacture and assemble, it is sturdy, and is dimensioned and proportioned to provide a stable pull toy that can readily be pulled along a flat surface by a small child.

The amusement device takes on the features of a puzzle by providing at least one set, and preferably several sets, of puzzle pieces, each set consisting of a small number, four in the preferred embodiment, of flat elongated strips of equal width and each of a length to be received, when oriented horizontally, in the vertically oriented pocket in the frame 22. The puzzle pieces of each set have fragmentary pictorial representations on each of its two flat surfaces which, when the puzzle pieces of the set are juxtaposed edgewise in the frame in correct order from bottom to top and with correct longitudinal orientation, create on the two opposite surfaces of the assembled puzzle pieces complete pictorial representation of two different views of the body portion of a wheeled vehicle. One such set of puzzle pieces is shown fully assembled in the frame in FIG. 1 and partially assembled in FIG. 2, the pictorial representation in this example depicting a fire engine, the outside of the body of the fire engine being depicted by the completed pictorial representation on the side surface of the assembled puzzle pieces visible in FIG. 1 and an interior view of the fire engine being depicted on the opposite surface in FIG. 2. In the commercial embodiment, the pictorial representations would be in several colors, characteristic of the vehicle being depicted; for the case shown in FIGS. 1 and 2, the body of the fire engine typically would be red, the ladder yellow, and the firemen's coats and the fire hose black. It will be noted that the pictorial representations on both of the opposite surfaces include, near the lower edge, representations of springs and shock absorbers which not only teach the child something about the construction of a fire engine (and a clue as to which puzzle piece should be inserted first), but creates the illusion, when the puzzle pieces are properly assembled, that the wheels of the wagon are operatively associated with the "fenders", springs and shock absorbers of the vehicle.

The puzzle pieces are preferably fabricated by laminating to the opposite flat surfaces of a sheet of ⅛ inch chipboard sheets of paper on which the two pictorial representations have previously been printed. The orientation of the pictorial representations on the board is such that the "front" of the depicted vehicle faces in the direction of the pull cord 18 regardless of the side from which the vehicle is viewed. The chipboard has a length corresponding substantially to the length of the pocket formed in the frame 22 and a width equal to the height of the frame, the corners being rounded to facilitate insertion into the pocket. The laminated assembly is then divided into a plurality of elongated strips 40, 42, 44 and 46, as by die-stamping, so that each side of each strip has thereon a fragmentary pictorial representation of a portion of the vehicle body.

In use, the puzzle pieces are scrambled, and the child "solves" the puzzle by inserting the strips, with horizontal orientation, through the opening 26 at the upper edge of the frame, in the proper order from bottom to top, and with correct horizontal orientation. Should the puzzle be assembled incorrectly, the error will be evident on both sides of the frame, whereupon the child will be challenged to remove the pieces, one by one through the opening 26, and to try again. Removal of the puzzle pieces is facilitated by the open area circumscribed by the frame, but a certain amount of dexterity is nonetheless required, whereby to teach the child manipulative skills. Once the puzzle pieces are correctly assembled, the child has the satisfaction of having assembled his own "fire engine" which he can pull about his play area, thereby to add to the play value of the device.

Figure 5:
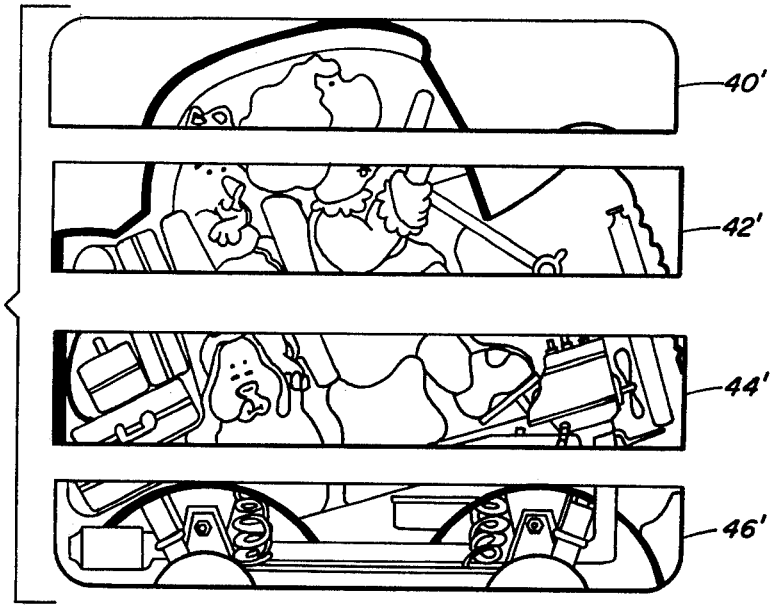
FIGS. 5 and 6 are plan views of the opposite flat surfaces of a second set of puzzle pieces.
Figure 6:
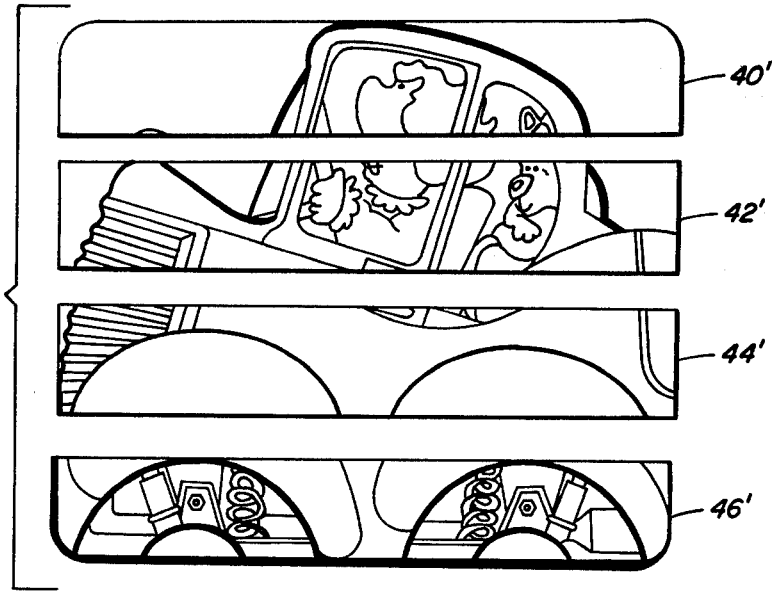

To add complexity to the puzzle, in its commercial form the device preferably includes several sets, say four, of four puzzle pieces each, all of the same size, each correctly assembled set depicting one of four different real-life four-wheeled vehicles, examples of which may be an ice cream truck, a garbage truck or a passenger car. FIGS. 5 and 6 show, by way of example, the opposite side surfaces of a second set of puzzle pieces which, when assembled, depict the "family car" from two different viewpoints. As in the case of the set of puzzle pieces depicting the fire engine, both sides of the lowermost strip 46' illustrate the "fenders", springs and shock absorbers of the vehicle to give the illusion of operative association with the wheels of the wagon, yet differ in minor structural detail (and also color, in the case of the actual device), to enable selection between several choices of the correct "fender" puzzle piece. The lowermost strip of the two additional sets of puzzle pieces (not shown) would carry similar representations of the underbody structure of the vehicle that the other pieces of each set are intended to depict. It will be evident that four sets of puzzle pieces, presenting sixteen separate pieces and thirty-two different sides, the fragmentary pictorial representations on several of which are quite similar, would present a significant challenge to a pre-school child, particularly when it is remembered that each of the strips has two possible "front-back" orientations, in "assembling" a desired one of the four vehicles.

Although the invention has been described with reference to a particular embodiment, variations within the spirit and scope of the invention will now be apparent to ones skilled in the art. For example, it will be understood that the wagon can be formed of materials other than plastic and may differ in structural detail, and that the puzzle pieces can be formed of material other than chipboard and/or the pictorial representations fixed thereto by known means other than by lamination.

We claim:

1. A movable puzzle comprising:

at least one set of puzzle pieces each of which consists of a plurality of elongated strips of planar configuration each having length and width dimensions substantially greater than its thickness and having a pictorial representation on at least one of its two flat surfaces which together form a complete pictorial representation on at least one planar face when juxtaposed in a planar configuration edgewise along their length dimension in correct order and with correct longitudinal orientation, and means for mounting said puzzle pieces in upstanding orientation so as to permit movement of the assembled puzzle pieces, said means including a vertically oriented generally rectangular frame having a vertically oriented pocket, open at the top, formed therein, said frame having a length approximately equal to the length of said puzzle pieces and a height dimension approximately equal to the overall width of the juxtaposed puzzle pieces, said frame being operative to provide upright support of puzzle pieces inserted therein through the open top of said pocket, and wheels supporting said frame permitting relative movement of said frame with respect to a surface, said mounting means being configured in a design which together with said complete pictorial representation forms a composite representation of a wheeled vehicle.

2. A movable puzzle according to claim 1, wherein the puzzle pieces of a set when correctly juxtaposed form on the two opposite planar faces thereof complete pictorial representations of two different views of the body portion of a wheeled vehicle.

3. A movable puzzle according to claim 1, further comprising a plurality of sets of puzzle pieces and wherein all of the puzzle pieces have the same length and width, the puzzle pieces of each set when correctly juxtaposed forming on the two opposite planar faces thereof complete pictorial representations of two different views of the body portion of a different one of a like plurality of wheeled vehicles.

4. A movable puzzle according to claim 1, wherein the puzzle pieces of a set when correctly juxtaposed form on at least one of its two flat surfaces a complete pictorial representation of the body portion of a wheeled vehicle, including underbody features which together with said mounting means forms a composite representation of a wheeled vehicle having its wheels operatively associated with said depicted underbody features.

5. A movable puzzle according to claim 1, wherein said frame is formed of transparent plastic material for rendering said pictorial representation visible throughout the length and combined width of said puzzle pieces when juxtaposed in planar configuration in said frame.

* * * * *